US006484463B1

(12) United States Patent
Fay

(10) Patent No.: US 6,484,463 B1
(45) Date of Patent: Nov. 26, 2002

(54) PRE-CUT FIBROUS INSULATION BATT AND METHOD OF MAKING THE BATT

(75) Inventor: Ralph Michael Fay, Lakewood, CO (US)

(73) Assignee: Johns Manville International, Inc., Denver, CO (US)

( * ) Notice: Subject to any disclaimer, the term of this patent is extended or adjusted under 35 U.S.C. 154(b) by 65 days.

(21) Appl. No.: 09/851,175

(22) Filed: May 7, 2001

(51) Int. Cl.[7] ..... E04B 1/74

(52) U.S. Cl. ..... 52/404.4; 52/98; 52/100; 52/309.4; 52/406.2; 428/43; 428/55; 428/74; 428/77; 428/138

(58) Field of Search ..... 52/98, 404.1, 406.1, 52/404.3, 309.8, 309.9, 406.2, 100; 428/43, 55, 74, 77, 138

(56) References Cited

U.S. PATENT DOCUMENTS 2,860,768 A * 11/1958 Smithers
3,624,161 A * 11/1971 Bub ..... 55/521
3,819,039 A * 6/1974 Erickson ..... 206/388
4,032,689 A * 6/1977 Johnson et al. ..... 428/55
4,035,538 A * 7/1977 Maekawa et al. ..... 428/155
4,426,818 A * 1/1984 Hoffman ..... 52/309.4
4,756,945 A * 7/1988 Gibb ..... 428/124
5,765,318 A * 6/1998 Michelsen ..... 52/98
6,185,895 B1 * 2/2001 Rettew ..... 52/528
6,378,258 B1 * 4/2002 Cunningham et al. ..... 52/404.1
6,383,594 B2 * 5/2002 Weinstein et al. ..... 428/43

* cited by examiner

*Primary Examiner*—Yvonne M. Horton
(74) *Attorney, Agent, or Firm*—Robert D. Touslee

(57) ABSTRACT

A resilient pre-cut fibrous insulation blanket includes first and second insulation blankets. The blankets each have a first major surface with one or more longitudinally extending cuts in the surface that are spaced inwardly from lateral edges of the surface and spaced apart from each other. The cuts only partially sever the blankets to form separable connectors in the blankets that join adjacent blanket sections formed by the cuts. The first major surfaces of the blankets are bonded to each other, with the cuts in the major surfaces of the blankets aligned longitudinally, to form a batt with longitudinally extending batt sections joined by the separable connectors in the blankets whereby the batt can be handled as a unit or one or more batt sections can be separated from the remainder of the batt by hand to form a batt of lesser width.

23 Claims, 3 Drawing Sheets

PRE-CUT FIBROUS INSULATION BATT AND METHOD OF MAKING THE BATT

BACKGROUND OF THE INVENTION

The present invention relates to a resilient fibrous insulation batt, and, in particular, to a resilient pre-cut fibrous insulation batt including two or more batt sections, that are separably connected together and can be torn away or separated by hand from the remainder of the batt, without the need to use a cutting tool, to form a batt having a lesser width than the pre-cut fibrous insulation batt for insulating a wall, floor, ceiling or roof cavity having a width less than the width of the pre-cut fibrous insulation batt and a method of making such a batt Building structures, such as residential houses, industrial buildings, office buildings, mobile homes, prefabricated buildings and similar structures, typically include walls (both interior and exterior), ceilings, floors, and roofs that are insulated for thermal and/or acoustical purposes, especially exterior walls, the ceilings below open attic spaces, and the roofs of such structures. The walls, ceilings, floors and roofs of these structures include framing members, e.g. studs, rafters, floor and ceiling joists, beams and similar support or structural members which are normally spaced-apart standard distances established by the building industry. Sheathing, paneling, lathing or similar construction materials are secured to these framing members to form the walls, ceilings, floors and roofs of the structures. While the builder or contractor seeks to maintain the spacing of the framing members in these structures at these standard distances for ease of construction and the insulation of the elongated cavities formed in these walls, ceilings, floors and roofs, frequently, the walls, ceilings, floors and roofs of these structures include elongated cavities defined, at least in part, by successive or adjacent framing members which are spaced-apart nonstandard distances less than the standard distance between framing members. Studies have shown that in a typical residential home, it is not uncommon for 25% or more of the framing members in the exterior walls of these structures to be spaced-apart at nonstandard distances less than the standard distance for such framing members. Thus, there has been a need for providing contractors with insulation batts that can be quickly and easily installed in a structure to insulate both standard and many nonstandard width cavities without the need to cut the insulation batts with a knife or other cutting tool to fit the cavities of nonstandard widths.

SUMMARY OF THE INVENTION

The insulation batt of the present invention provides a solution to the problem discussed above. The resilient pre-cut fibrous insulation batt of the present invention includes first and second resilient fibrous insulation blankets. While the insulation blankets may be made from other fibers, preferably, the blankets are made of glass fibers. The blankets each have a first major surface with one or more longitudinally extending cuts in the surface that are spaced inwardly from lateral edges of the surface and spaced apart from each other. The cuts, which may be continuous or discontinuous, only partially sever the blankets to form separable connectors in the blankets that join adjacent blanket sections formed by the cuts. The first major surfaces of the blankets are bonded to each other, with the cuts in the major surfaces of the blankets aligned longitudinally, to form a batt with longitudinally extending batt sections joined by the separable connectors in the blankets whereby the batt can be handled as a unit or one or more batt sections can be separated from the remainder of the batt by hand to form a batt of lesser width. Preferably, the cut(s) in each blanket have a maximum depth less than the thickness of the blanket so that the second major surfaces of the blankets, which form the outer major surfaces of the batt, remain uncut. The outer major surfaces of the batts can be marked longitudinally in alignment with the cut(s) to show the installer where the resilient pre-cut fibrous insulation batt can be separated into sections by hand to form a batt having a lesser width to insulate wall, floor, ceiling, and roof cavities having widths less than the width of the pre-cut fibrous insulation batt In a preferred method of making the resilient pre-cut fibrous insulation batt of the present invention, a resilient insulation blanket is fed through a cutting station where the blanket is cut transversely intermediate its major surfaces, in a plane parallel to the major surfaces of the blanket, to form first and second blankets of the same width having thicknesses less than the original insulation blanket or, rather than cutting an insulation blanket intermediate its major surfaces to form two blankets of lesser width, first and second blankets of the same width are selected to form the resilient pre-cut fibrous insulation batt The opposed major surfaces of the first and second blankets are then cut or severed longitudinally. The one or more cuts formed in each of the opposed inner major surfaces of the first and second blankets: are spaced inwardly from lateral edges of the major surfaces; are spaced apart from each other; and extend parallel to the lateral edges of the major surfaces and each other. Preferably, the cut or cuts in each blanket, which may be continuous or discontinuous cuts, have a maximum depth less than the thickness of the blanket so that the outer major surface of the blanket is uncut. An adhesive or bonding agent is then applied to one or both of the opposed major surfaces of the first and second blankets and the opposed major surfaces of the blankets are then brought into contact and bonded together to form, the resilient fibrous insulation batt with the cuts in the opposed major surfaces of the first and second blanket in longitudinal alignment. Lines or other marking can then be made on one or both of the outer major surfaces of the batt, in alignment with the cuts, to show the installer where the batt can be separated.

DESCRIPTION OF THE PREFERRED EMBODIMENTS

Figure 1:
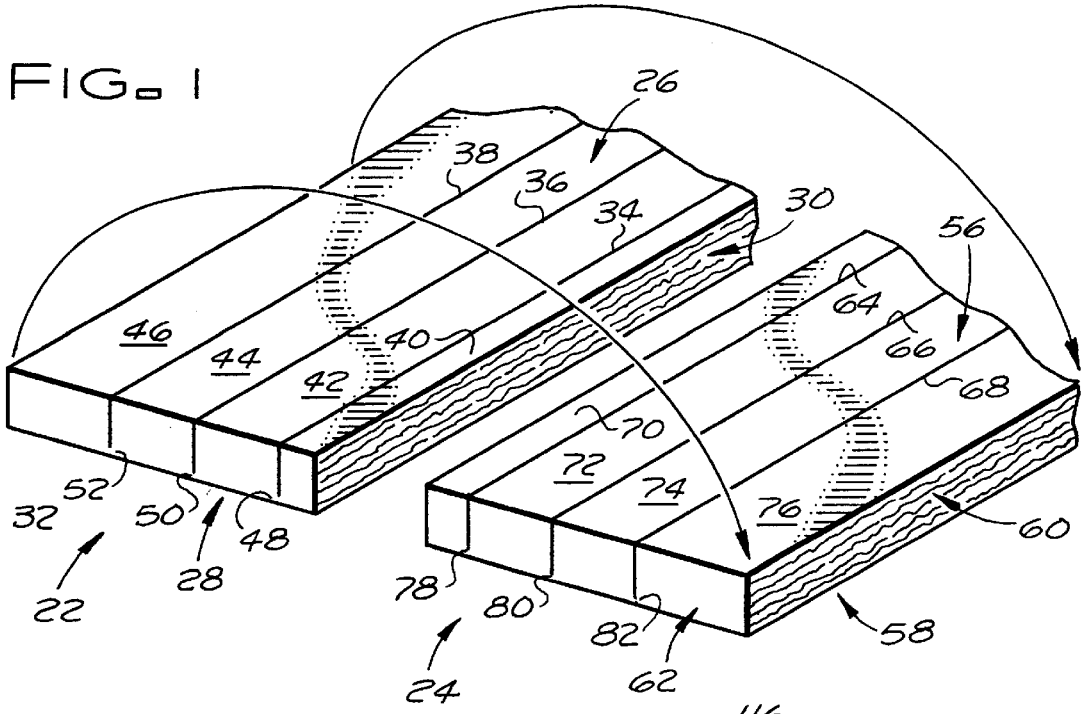
FIG. 1 is a partial schematic perspective view of first and second resilient fibrous insulation blankets that may be used to form the resilient pre-cut fibrous insulation batt of the present invention.
Figure 2:
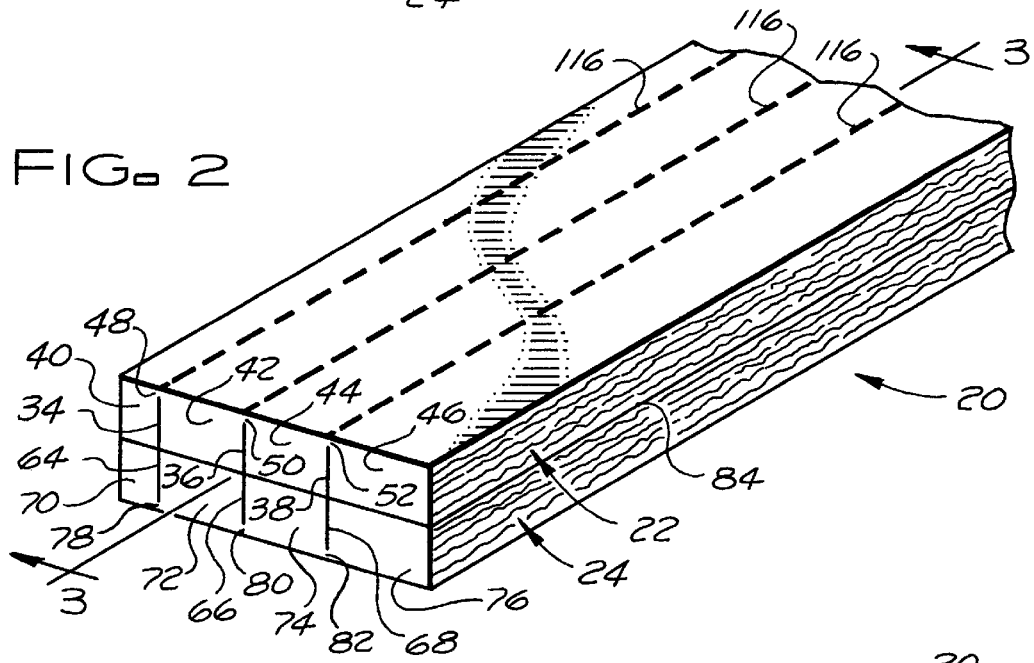
FIG. 2 is a partial schematic perspective view of a resilient pre-cut fibrous insulation batt of the present invention made from the blankets of FIG. 1.

As shown in FIGS. 1 and 2, the resilient pre-cut fibrous insulation batt 20 of the present invention includes first and second resilient fibros insulation blankets 22 and 24. While the resilient pre-cut fibrous insulation batt 20 nay be made of other fibrous materials, preferably, the resilient pre-cut fibrous insulation batt 20 is made of randomly oriented, entangled glass fibers and has a density between about 0.4 pounds/ft$^3$ and about 1.5 pounds/ft$^3$. Examples of other fibers that may be used to form the resilient pre-cut fibrous insulation batt are mineral fibers, such as but riot limited to, rock wool fibers, slag fibers, and basalt fibers, and organic fibers, such as but not limited to, polypropylene, polyester and other polymeric fibers. The fibers of the resilient pre-cut fibrous insulation batt 20 may be bonded together for increased batt integrity, e.g. by a binder at their points of intersection, such as but not limited to urea phenol formaldehyde or other suitable bonding materials, or the resilient pre-cut fibrous insulation batt 20 may be binderless provided the batt possesses the required integrity.

Due to its resilience, the pre-cut fibrous insulation batt 20 can be compressed to reduce the batt in thickness for packaging, e.g. to a thickness about ⅕ to about ⅛ of its original thickness, and contained in its compressed state in a package of typically six or more batts. When the resilient pre-cut fibrous insulation batt 20 is removed from its insulation package, the batt recovers to substantially its pro-compressed thickness. After a pre-cut resilient fibrous insulation batt 20 or one or more sections of the batt is compressed in width and inserted into a wall, floor, ceiling ( or roof cavity having a width somewhat less in width than the width of the resilient pre-cut fibrous insulation batt or batt section(s), the resilient pre-cut fibrous insulation batt 20 or batt section(s) will expand to the width of the cavity and press against the sides of the cavity to hold or help hold the resilient pre-cut fibrous insulation batt 20 or batt section(s) in place.

Typically, for most applications, such as walls in residential houses, the resilient pre-cut fibrous insulation batt 20 is about forty-six to about forty-eight inches or about ninety-three to about ninety-six inches in length. Typically, the width of the resilient pre-cut fibrous insulation batt 20 is equal to or somewhat creater than a standard cavity width for the cavities to be insulated, e.g. about fifteen inches in width for a cavity where the center to center spacing of the wall, floor, ceiling or roof framing members is about sixteen inches (the cavity having a width of about fourteen and one half inches) and about twenty three inches in width for a cavity where the center to center spacing of the wall, floor, ceiling or roof framing members is about twenty four inches (the cavity having a width of about twenty two and one half inches). However, for other applications, the resilient pre-cut fibrous insulation batt 20 may have different widths, such as but not limited to about thirteen to about thirteen and one half inches.

The amount of thermal or sound control desired and the depth of the cavities being insulated determine the thickness of the resilient pre-cut fibrous insulation batt 20 used to insulate a cavity. Typically, the resilient pre-cut fibrous insulation batt is about three to about ten inches or more in thickness and approximates the depth of the cavity being insulated. For example, in a wall cavity defined in part by nominally 2×4 or 2×6 inch studs or framing members, a resilient pre-cut fibrous insulation batt will have a thickness of about three and one half or about five and one half inches, respectively.

The resilient fibrous insulation batt 20 may be faced, e.g. with a kraft paper, or foil-scrim-kraft paper facing bonded to a major surface of the batt or unfaced as shown in FIGS. 1 and 2. The following examples illustrate how one or more sections of the unfaced or faced resilient pre-cut fibrous insulation batt 20 may be separated from each other to form batts of lesser widths than the resilient pre-cut fibrous insulation batt 20. Preferably, for a batt 20, having a width of about fifteen inches, which is divided into four batt sections, the batt sections are about two and one half, about four, about four, and about four and one half inches in width. The two and one half inch section may be used to insulate a cavity up to about two inches in width; the four and one half inch section may be used to insulate a cavity from about two to about four inches in width; the adjacent two and one half and four inch sections, together, may be used to insulate a cavity from about four to about six inches in width; the adjacent four and four and one inch sections, together, may be used to insulate a cavity from about six and one half to about eight inches in width; the two and one half and both four inch wide sections, together, may be used to insulate a cavity from about eight and one half to about to about ten inches in width; both four inch and the four and one half inch sections may be used to insulate a cavity from about ten and one half to about twelve inches in width; and the entire batt, as a unit, may be used to insulate a cavity having a width from about twelve and one half to about fourteen and one half inches. Preferably, for a twenty-three inch wide resilient pre-cut fibrous insulation batt 20 that is divided into six sections, the batt sections are about three, about four, about four, about three, about four and about five inches wide. As illustrated with the fifteen wide batt, different batt sections or different combinations of adjacent batt sections can be separated from the twenty three inch wide resilient pre-cut fibrous insulation batt 20 to insulate cavities of various widths less than the width of the resilient pre-cut fibrous insulation batt 20.

The blanket 22 of the resilient pre-cut fibrous insulation batt 20 has a first or inner major surface 26, a second or outer major surface 28, lateral surfaces 30 and end surfaces 32. The first major surface 26 has one or more, preferably three or more longitudinally extending, laterally spaced apart cuts (cuts 34, 36 and 38 are shown) that divide the blanket into two or more blanket sections, preferably four or more blanket sections (blanket sections 40, 42, 44 and 46 are shown). The cuts 34, 36, and 38 extend perpendicular to the major surfaces 26 and 28 of the blanket, parallel to each other, and parallel to the lateral surfaces 30 of the blanket. The cuts 34, 36 and 38, which may be continuous or discontinuous, only partially sever the blanket 22 to form separable connectors 48, 50 and 52 in the blanket that separably join the blanket sections together. These separable connectors 48, 50 and 52 hold the adjacent blanket sections together for handling but can be separated or torn apart by hand (separated or torn apart without the need to use a cutting tool such as but not limited to a knife) to separate the blanket sections. Preferably, the cuts 34, 36 and 38 have a maximum depth less than the thickness of the blanket 22 so that the second major surface remains uncut, e.g. the cuts extend to within about ⅛ to about 1/16 of an inch of the second major surface 28.

The blanket 24 of the resilient pre-cut fibrous insulation batt 20 has a first or inner major surface 56, a second or outer major surface 58, lateral surfaces 60 and end surfaces 62. The first major surface 56 has one or more, preferably three or more longitudinally extending, laterally spaced apart cuts (cuts 64, 66 and 68 are shown) that divide the blanket into two or more blanket sections, preferably four or more blanket sections (blanket sections 70, 72, 74 and 76 are shown). The cuts 64, 66, and 68 extend perpendicular to the major surfaces 56 and 58 of the blanket, parallel to each other, and parallel to the lateral surfaces 60 of the blanket. The cuts 64, 66 and 68, which may be continuous or discontinuous, only partially sever the blanket 24 to form separable connectors 78, 80 and 82 in the blanket that separably join the blanket sections together. These separable connectors 78, 80 and 82 hold the adjacent blanket sections together for handling but can be separated or torn apart by hand (separated or torn apart without the need to use a cutting tool such as but not limited to a knife) to separate the blanket sections. Preferably, the cuts 64, 66 and 68 have a maximum depth less than the thickness of the blanket 24 so that the second major surface remains uncut, e.g. the cuts extend to within about ⅛ to about 1/16 of an inch of the second major surface 58.

The cuts 34, 36 and 38 in the first major surface 26 of the first blanket 22 and the cuts 64, 66, and 68 in the first major surface 56 of the second blanket 24 are spaced from the lateral edges of the major surfaces and from each other so that the cuts 34 and 64, 36 and 66, and 38 and 68 are aligned or substantially aligned with each other when the first blanket 22 is laid upon the second blanket 24 with the major surfaces 26 and 56 of the blankets 22 and 24 in contact as shown by the arrows in FIG. 1 to form the resilient pre-cut fibrous insulation batt 20 of FIG. 2. In the resilient pre-cut fibrous insulation batt 20, the first major surface 26 of the first blanket 22 is bonded to the first major surface 56 of the second blanket 24 by a thin coating or thin layer 84 of a conventional bonding agent or adhesive, such as but not limited to a hot melt adhesive that may be applied to one or both of the major surfaces 26 and 56. In the resilient pre-cut fibrous insulation batt 20, the blanket sections 40 and 70, 42 and 72, 44 and 74, and 46 and 76, which are bonded together by the adhesive layer 84, each form a batt section that is separably joined to an adjacent batt section or batt sections by the separable connectors 48 and 78, 50 and 80, and 52 and 82. With this structure, the resilient pre-cut fibrous insulation batt 20 can be handled as a unit for packaging, storage, and installation in a cavity having a width about equal to the width of the batt or one or more batt sections can be separated or torn away from the remainder of the batt by hand to form a batt having a lesser width to insulate a cavity having a width less than the width of the resilient pre-cut fibrous insulation batt 20.

Figure 3:
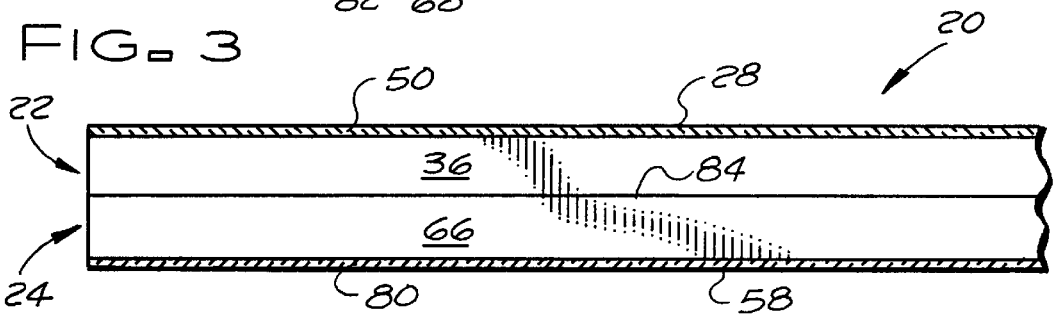
FIG. 3 is a partial schematic cross section, taken substantially along lines 3—3 of FIG. 2, to show the cuts and separable connectors in the batt

As shown in FIGS. 1 to 3, the cuts 34, 36, 38 in the first blanket 22 and the cuts 64, 66, 68 in the second blanket 24 can be continuous with the separable connectors 48, 50 and 52 formed in the first blanket 22 and the separable connectors 78, 80 and 82 formed in the second blanket being formed by those portions of the blankets remaining uncut intermediate the bottoms of the cuts and the second major surfaces 28 and 58 of the blankets.

Figure 4:
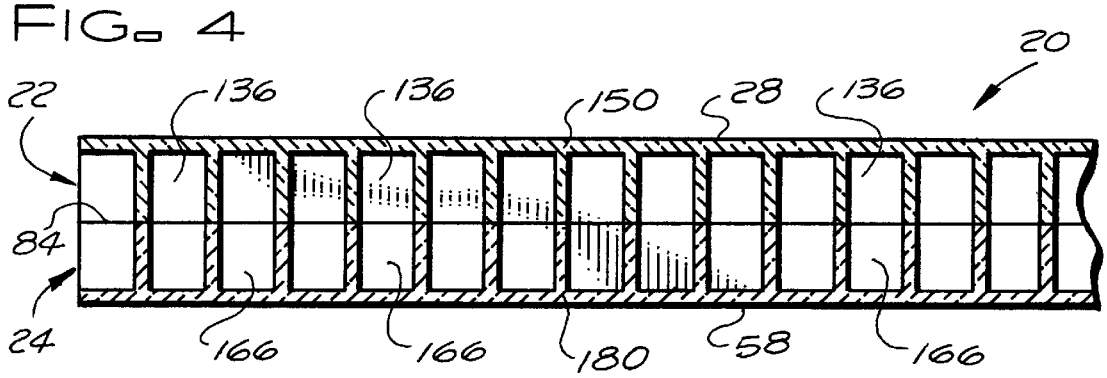
FIGS. 4 and 5 are partial schematic cross sections of alternative forms of cuts and separable connectors in the batt taken along lines in these embodiments of the batt that would correspond to lines 3—3 of FIG. 2.
Figure 5:
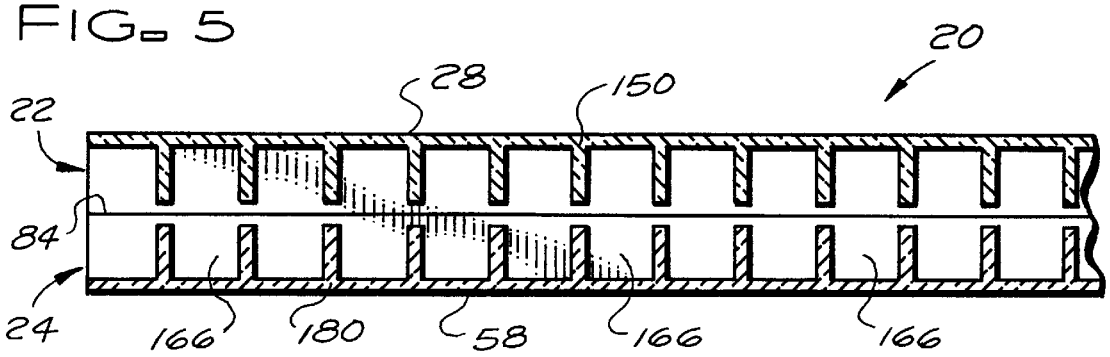

As shown in FIGS. 4 and 5, respectively, the cuts forming the separable connectors in the first and second blankets 22 and 24 can also be discontinuous cuts or continuous cuts of varying depth. In FIGS. 4 and 5, the cuts 136 in the first blanket 22 and the cuts 166 in the second blanket 24, which correspond to the cuts 36 and 66 of FIG. 3, form separable connectors 150 and 180 respectively. The separable connectors 150 and 180 each have first portions formed by those portions of the blankets remaining uncut intermediate the bottoms of the cuts 136 and 166 and the second major surfaces 28 and 58 of the blankets and second portions, formed by a series of uncut blanket portions intermediate the cuts 136 and 166 in the blankets (FIG. 4) or deeper portions of the cuts 136 and 166 in the blankets (FIG. 5), that extend from the first portions of the separable connectors to the first or inner major surfaces of the blankets (FIG. 4) or part of the way to the first or inner major surfaces of the blankets (FIG. 5). As with the separable connectors of FIGS. 1 to 3, the separable connectors in the resilient pre-cut fibrous insulation batt 20 of FIGS. 4 and 5 separably join adjacent batt sections together so that the batt can be handled as a unit for packaging, storage, and installation in a cavity having a width about equal to the width of the batt or one or more batt sections can be separated or torn away from the remainder of the batt by hand to form a batt having a lesser width to insulate a cavity having a width less than the width of the resilient pre-cut fibrous insulation batt 20.

Figure 6:
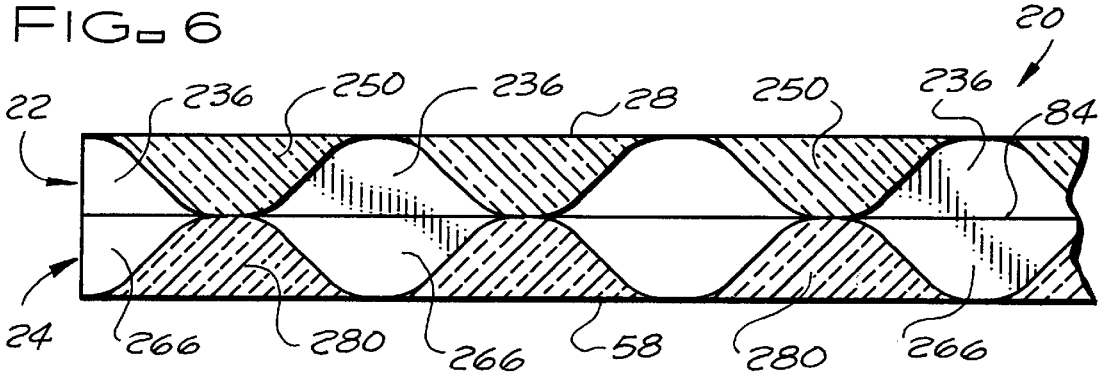
FIGS. 6 and 7 are partial schematic cross sections of alternative forms of cuts and separable connectors in the batt taken along lines in these embodiments of the batt that would correspond to lines 3—3 of FIG. 2.
Figure 7:
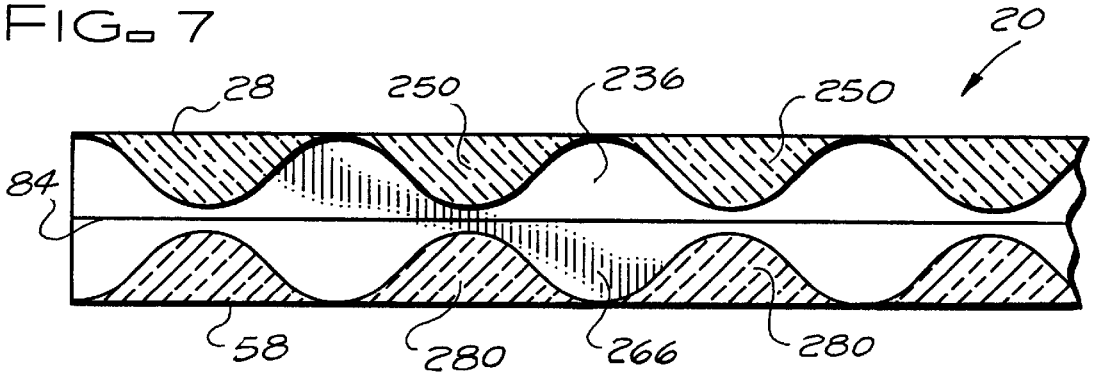

As shown in FIGS. 6 and 7, the cuts forming the separable connectors in the first and second blankets 22 and 24 can be discontinuous cuts or continuous cuts which may have portions that extend all of the way through the blankets to the outside major surfaces 28 and 58 of the blankets. In FIGS. 6 and 7 the cuts 236 in the first blanket 22 and the cuts 266 in the second blanket 24, which correspond to the cuts 36 and 66 of FIG. 3, form separable connectors 250 and 280 respectively. As shown, the separable connectors 250 and 280 are formed by a series of uncut blanket portions, intermediate the discontinuous cuts 236 and 266 in the blankets (FIG. 6) or intermediate the deeper portions of the cuts 236 and 266 in the blankets (FIG. 7), that extend from the outer major surfaces 28 and 58 of the blankets 22 and 24 to the first or inner major surfaces of the blankets (FIG. 6) or part of the way to the first or inner major surfaces of the blankets (FIG. 7). As with the separable connectors of FIGS. 1 to 3, the separable connectors in the resilient pre-cut fibrous insulation batt 20 of FIGS. 6 and 7 separably join adjacent batt sections together so that the batt can be handled as a unit for packaging, storage, and installation in a cavity having a width about equal to the width of the batt or one or more batt sections can be separated or torn away from the remainder of the batt by hand to form a batt having a lesser width to insulate a cavity having a width less than the width of the resilient pre-cut fibrous insulation batt 20. While the separable connectors 250 and 280 of FIGS. 6 and 7 are a series of separable connectors separated by the cuts 236 and 266, where the cuts 236 and 266 do not extend all of the way through the blankets to the outer major surfaces 28 and 58 of the blankets 22 and 24, the separable connectors 250 and 280 would be continuous and have portions intermediate the bottoms of the cuts and the outer major surfaces of the blankets joining the portions of the separable connectors separated by the cuts 236 and 266. With the embodiments of FIGS. 1 to 7, the resilience of the blankets 22 and 24 causes the cuts to close after the cuts are formed in the blanket.

Figure 8:
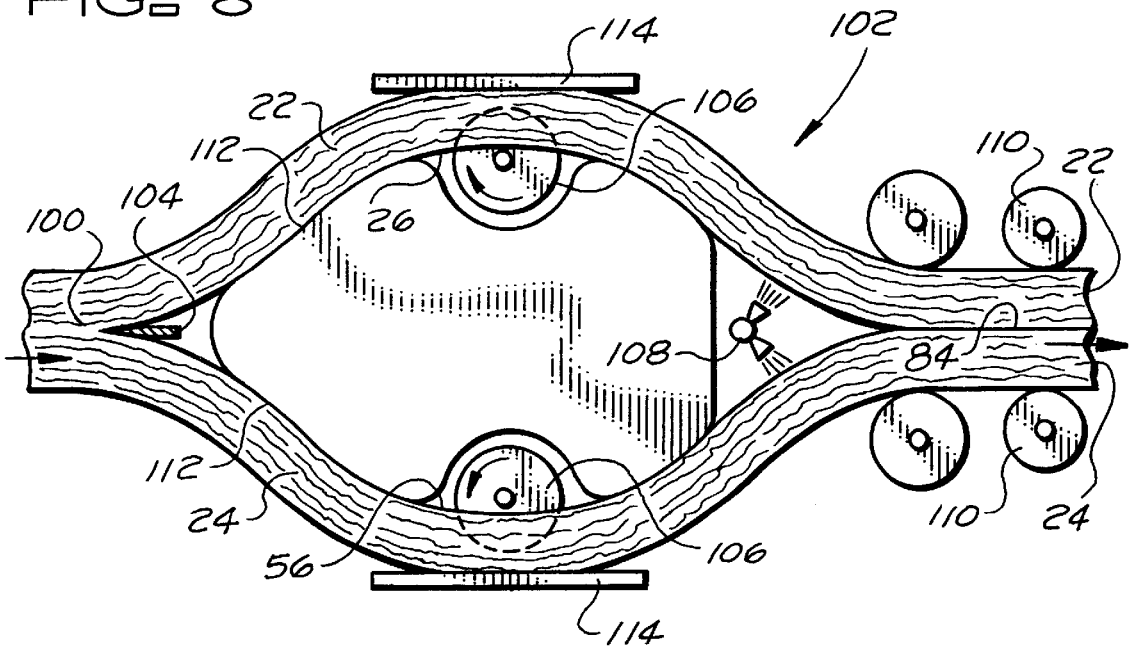
FIG. 8 is a schematic side elevation view of a portion of a production line that may be used to make the resilient fibrous insulation batt of the present invention.

The resilient pre-cut fibrous insulation batt 20 of the present invention can be formed in an in line process wherein a resilient fibrous insulation blanket 100 is formed of randomly oriented entangled fibers, e.g. glass fibers. The fibers of the blanket 100 may be bonded together at their points of intersection with a binder or the blanket may be binderless. Where the blanket contains a binder, the binder is cured in an oven. As schematically shown in FIG. 8, the blanket 100 is fed through a cutting station 102 that includes a band saw or other cutting equipment 104 for cutting the blanket transversely and parallel to the major surfaces of the blanket 100 to form the blankets 22 and 24; compression-slitters 106 for cutting the blankets 22 and 24 longitudinally and forming separable connectors joining adjacent blanket sections; and an adhesive applicator 108. The cutting station 102 may also include marking equipment 110 for marking one or both major surfaces of the resilient pre-cut fibrous insulation batt 20 formed from the blankets 22 and 24, e.g. by searing the surface of the batt or applying an ink, a dye or other marking solution to the surface of the batt in a continuous or dashed line in alignment with the cuts, to show where the cuts are located in the batt As the resilient insulation blanket 100 is fed through a cutting station 102 the band saw or other cutting equipment 104 cuts the blanket 100 transversely intermediate its major surfaces across its entire width and in a plane parallel to the major surfaces of the blanket, to form the first and second blankets 22 and 24 having thicknesses less than the original insulation blanket 100. The thicknesses of the blankets 22 and 24 may be equal or differ. The blankets 22 and 24 then slide over a blanket guide plate 112 that separates the blankets 22 and 24 and guides the blankets to the compression-slitters 106. As the blankets 22 and 24 are fed past the compression-slitters 106, the opposed major surfaces 26 and 56 of the blankets 22 and 24 are cut or severed longitudinally by the compression-slitters 106 as the blankets 22 and 24 pass between the rotating compression-slitters 106 and backing plates 114. The linear speed of the peripheral cutting edges of the rotating compression-slitters 106 and the linear speed of the blankets 22 and 24 are equal or substantially equal so that the blankets are not torn by the compression-slitters and the peripheral edges of the compression-slitters 106 are spaced from the opposing surfaces of the backing plates 114 so that the cuts formed in the blankets by the compression-slitters do not pass completely through the blankets 22 and 24 to the outer major surfaces of the blankets which form the major surfaces of the resilient pre-cut fibrous insulation batts 20. The one or more cuts formed in each of the opposed inner major surfaces of the blankets 22 and 24: are spaced inwardly from lateral edges of the major surfaces of the blankets; are spaced apart from each other; and extend parallel to the lateral surfaces of the blankets and each other. The cut or cuts in the blanket 22 are aligned longitudinally with the cut or cuts in the blanket 24. Preferably, the cut or cuts in each blanket have a maximum depth about ⅛ to about 1/16 of an inch less than the thickness of the blanket. An adhesive or bonding agent is then applied to one or both of the opposed major surfaces 26 and 56 of the blankets 22 and 24 and the opposed major surfaces of the blankets are then brought back into contact and bonded together by the adhesive layer 84 to form the resilient pre-cut fibrous insulation batt 20 with the cuts in the opposed major surfaces of the first and second blanket in longitudinal alignment. Continuous or dashed lines or other marking 116, in alignment with the cuts, can then be made on one or both of the outer major surfaces of the batt with an embossed searing roll or other marking equipment 110 to show the installer where the resilient pre-cut fibrous insulation batt 20 can be separated.

Figure 9:
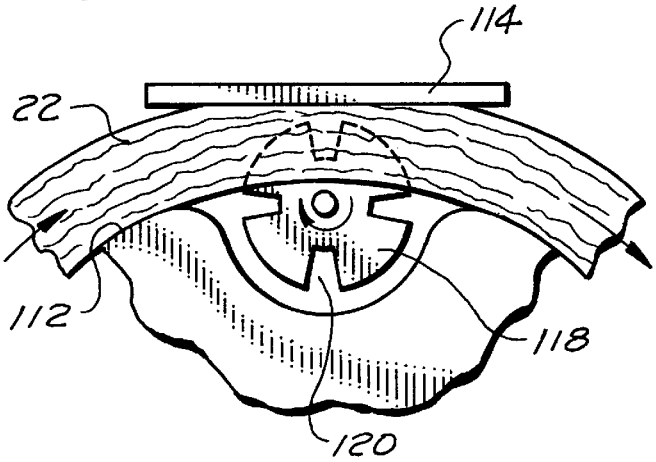
FIG. 9 is schematic side elevation of a portion of a production line, with a notched rotating compression-slitter, that may be used to make the resilient fibrous insulation batt of the present invention with cuts and separable connectors such as the cuts and separable connectors shown in FIGS. 4 and 5.
Figure 10:
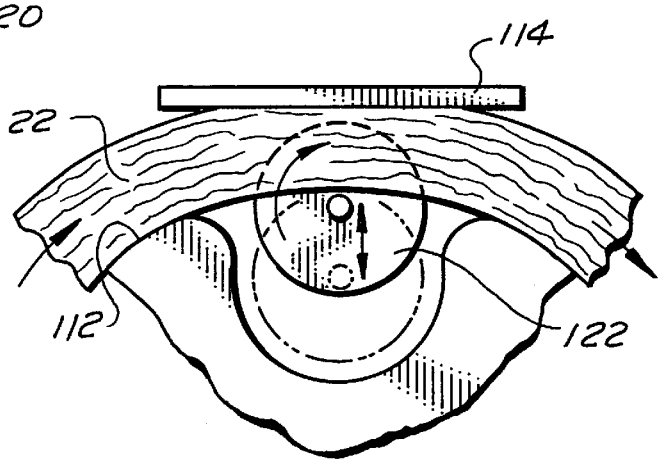
FIG. 10 is schematic side elevation of a portion of a production line, with a rotating compression-slitter or saw that is also reciprocated vertically, that may be used to make the resilient fibrous insulation batt of the present invention with cuts and separable connectors such as the cuts and separable connectors shown in FIGS. 6 and 7.

The compression-slitters 106 shown in FIG. 8 are for forming continuous cuts in the blankets 22 and 24. The rotating notched compression-slitters 118 of FIG. 9 (only one of which is shown) are used to form the discontinuous cuts shown in FIG. 4 or the continuous cuts shown in FIG. 5. As with the compression-slitters 106, the peripheral edges of the compression-slitters 118 are spaced from the opposing surfaces of the backing plates 114 to keep the cuts from penetrating to the outer major surfaces of the resilient pre-cut fibrous insulation batt 20. When forming the cuts of FIG. 5, the notches 120 in the rotating compression-slitters 118 have a depth that causes the blanket 22 to be cut all along the first or inner major surface of the blankets to form separable connectors such as the separable connectors 150 and 180 shown in FIG. 5. The rotating compression-slitters 122 of FIG. 10, in addition to rotating about their axis, are reciprocated up and down as the blanket passes between the compression-slitters 122 and the backing plate 114 to form cuts such as the cuts 236 and 266 schematically shown in FIGS. 6 and 7. The amplitude and speed of the reciprocating movement of the rotating compression-slitters 122 determines the contour of the cuts and whether or not the cuts intermittently pass completely through to the outer surface of the blanket. While FIGS. 9 and 10 only show the blanket 22 being cut and only show one of a series of compression-slitters 118 and 122 for cutting the blanket 22 that are spaced across the width of the blanket to form the longitudinally extending cuts at the desired locations in the blanket 22, it is to be understood that a second series of compression-slitter assemblies, not shown, would be used to cut the blanket 24.

In describing the invention, certain embodiments have been used to illustrate the invention and the practices thereof. However, the invention is not limited to these specific embodiments as other embodiments and modifications within the spirit of the invention will readily occur to those skilled in the art on reading the specification. Thus, the invention is not intended to be limited to the specific embodiments disclosed, but is to be limited only by the claims appended hereto.

What is claimed is:

1. A resilient pre-cut fibrous insulation batt, comprising:

a first resilient fibrous insulation blanket; the first blanket having a length, a width and a thickness; the first blanket having first and second major surfaces extending the length and width of the first blanket; the first blanket having a longitudinally extending first cut in the first major surface of the first blanket; the first cut in the first blanket being spaced inwardly from lateral edges of the first major surface of the first blanket and only partially severing the first blanket longitudinally to form first separable connector means in the first blanket; the first separable connector means in the first blanket separably joining adjacent blanket sections formed by the first cut in the first blanket for handling but permitting the adjacent blanket sections to be separated from each other by hand;

a second resilient fibrous insulation blanket; the second blanket having a length, a width and a thickness; the second blanket having first and second major surfaces extending the length and width of the second blanket; the second blanket having a longitudinally extending first cut in the first major surface of the second blanket; the first cut in the second blanket being spaced inwardly from lateral edges of the first major surface of the second blanket and only partially severing the second blanket longitudinally to form first separable connector means in the second blanket; the first separable connector means in the second blanket separably joining adjacent blanket sections formed by the first cut in the second blanket for handling but permitting the adjacent blanket sections in second blanket to be separated from each other by hand; and the first major surface of the second blanket being bonded to the first major surface of the first blanket with the longitudinally extending first cut of the second blanket substantially aligned with the longitudinally extending first cut of the first blanket to form a resilient pre-cut fibrous insulation batt having a length equal to the length of the blankets, a width equal to the width of the blankets, and a thickness equal to the combined thicknesses of the blankets; the resilient pre-cut fibrous insulation batt having longitudinally extending batt sections separably joined by the first separable connector means of the first and second blankets whereby the pre-cut fibrous insulation batt is handled as a unit to insulate a cavity having a width about equal to the width of the resilient pre-cut fibrous insulation batt or the adjacent batt sections are separated by hand to insulate a cavity having a lesser width than the resilient pre-cut fibrous insulation batt.

2. The resilient pre-cut fibrous insulation batt according to claim 1, wherein:

the first cut in the first major surface of the first blanket has a maximum depth less than the thickness of the first blanket so that the second major surface of the first blanket is uncut; and the first cut in the first major surface of the second blanket has a maximum depth less than the thickness of the second blanket so that the second major surface of the second blanket is uncut.

3. The resilient pre-cut fibrous insulation batt according to claim 2, wherein:

the first cut in the first major surface of the first blanket has a maximum depth about ⅛ to about 1/16 of an inch less than the thickness of the first blanket; and the first cut in the first major surface of the second blanket has a maximum depth about ⅛ to about 1/16 of an inch less than the thickness of the second blanket.

4. The resilient pre-cut fibrous insulation batt according to claim 2, wherein:

the first cut in the first major surface of the first blanket is continuous; and the first cut in the first major surface of the second blanket is continuous.

5. The resilient pre-cut fibrous insulation batt according to claim 2, wherein:

the first cut in the first major surface of the first blanket is discontinuous with portions of the first separable connector means of the first blanket intermediate portions of the first cut in the first blanket; and the first cut in the first major surface of the second blanket is discontinuous with portions of the first separable connector means of the second blanket intermediate portions of the first cut in the second blanket.

6. The resilient pre-cut fibrous insulation batt according to claim 1, wherein:

the first cut in the first major surface of the first blanket is continuous; and the first cut in the first major surface of the second blanket is continuous.

7. The resilient pre-cut fibrous insulation batt according to claim 1, wherein:

the first cut in the first major surface of the first blanket is discontinuous with portions of the first separable connector means of the first blanket intermediate portions of the first cut in the first blanket; and the first cut in the first major surface of the second blanket is discontinuous with portions of the first separable connector means of the second blanket intermediate portions of the first cut in the second blanket.

8. The resilient pre-cut fibrous insulation batt according to claim 1, wherein:

the first blanket and the second blanket are glass fiber insulation blankets.

9. The resilient pre-cut fibrous insulation batt according to claim 1, wherein:

the first blanket has a longitudinally extending second cut in the first major surface of the first blanket that is spaced inwardly from the lateral edges of the first blanket and substantially parallel to and spaced from the first cut in the first major surface of the first blanket; the second cut in the first major surface of the first blanket only partially severs the first blanket longitudinally to form second separable connector means in the first blanket that separably joins adjacent blanket sections formed by the second cut in the first blanket for handling but permits the blanket sections adjacent the second cut in the first blanket to be separated from each other by hand;

the second blanket has a longitudinally extending second cut in the first major surface of the second blanket that is spaced inwardly from the lateral edges of the second blanket and substantially parallel to and spaced from the first cut in the first major surface of the second blanket; the second cut in the first major surface of the second blanket only partially severs the second blanket longitudinally to form second separable connector means in the second blanket that separably joins adjacent blanket sections formed by the second cut in the second blanket for handling but permits the blanket sections adjacent the second cut in the second blanket to be separated from each other by hand; and in the resilient pre-cut fibrous insulation batt, the longitudinally extending second cut of the second blanket is substantially aligned with the longitudinally extending second cut of the first blanket; and the resilient pre-cut fibrous insulation batt has longitudinally extending batt sections separably joined by the second separable connector means of the first and second blankets whereby the pre-cut fibrous insulation batt is handled as a unit to insulate a cavity having a width about equal to the width of the resilient pre-cut fibrous insulation batt or the adjacent batt sections of the batt are separated by hand to insulate a cavity having a lesser width than the resilient pre-cut fibrous insulation batt.

10. The resilient pre-cut fibrous insulation batt according to claim 9, wherein:

the first and second cuts in the first major surface of the first blanket have a maximum depth less than the thickness of the first blanket so that the second major surface of the first blanket is uncut; and the first and second cuts in the first major surface of the second blanket have a maximum depth less than the thickness of the second blanket so that the second major surface of the second blanket is uncut.

11. The resilient pre-cut fibrous insulation batt according to claim 10, wherein:

the first and second cuts in the first major surface of the first blanket have a maximum depth about ⅛ to about 1/16 of an inch less than the thickness of the first blanket; and the first and second cuts in the first major surface of the second blanket have a maximum depth about ⅛ to about 1/16 of an inch less than the thickness of the second blanket.

12. The resilient pre-cut fibrous insulation batt according to claim 10, wherein:

the first and second cuts in the first major surface of the first blanket are continuous; and the first and second cuts in the first major surface of the second blanket are continuous.

13. The resilient pre-cut fibrous insulation batt according to claim 10, wherein:

the first cut in the first major surface of the first blanket is discontinuous with portions of the first separable connector means of the first blanket intermediate portions of the first cut in the first blanket; the second cut in the first major surface of the first blanket is discontinuous with portions of the second separable connector means of the first blanket intermediate portions of the second cut in the first blanket; and the first cut in the first major surface of the second blanket is discontinuous with portions of the first separable connector means of the second blanket intermediate portions of the first cut in the second blanket; and the second cut in the first major surface of the second blanket is discontinuous with portions of the second separable connector means of the second blanket intermediate portions of the second cut in the second blanket.

14. The resilient pre-cut fibrous insulation batt according to claim 9, wherein:

the first and second cuts in the first major surface of the first blanket are continuous; and the first and second cuts in the first major surface of the second blanket are continuous.

15. The resilient pre-cut fibrous insulation batt according to claim 9, wherein:

the first cut in the first major surface of the first blanket is discontinuous with portions of the first separable connector means of the first blanket intermediate portions of the first cut in the first blanket; the second cut in the first major surface of the first blanket is discontinuous with portions of the second separable connector means of the first blanket intermediate portions of the second cut in the first blanket; and the first cut in the first major surface of the second blanket is discontinuous with portions of the first separable connector means of the second blanket intermediate portions of the first cut in the second blanket; and the second cut in the first major surface of the second blanket is discontinuous with portions of the second separable connector means of the second blanket intermediate portions of the second cut in the second blanket.

16. The resilient pre-cut fibrous insulation batt according to claim 9, wherein:

the first blanket and the second blanket are glass fiber insulation blankets.

17. A method of making a resilient pre-cut fibrous insulation batt, comprising:

forming a first cut in a first resilient fibrous insulation blanket; the first blanket having a length, a width, and a thickness; the first blanket having first and second major surfaces extending the length and width of the first blanket; the first cut in the first blanket extending longitudinally in the first major surface of the first blanket, being spaced inwardly from lateral edges of the first major surface of the first blanket, and only partially severing the first blanket longitudinally to form first separable connector means in the first blanket; the first separable connector means in the first blanket separably joining adjacent blanket sections formed by the first cut in the first blanket for handling but permitting the adjacent blanket sections to be separated from each other by hand;

forming a first cut in a second resilient fibrous insulation blanket; the second blanket having a length, a width and a thickness; the second blanket having first and second major surfaces extending the length and width of the second blanket; the first cut in the second blanket extending longitudinally in the first major surface of the second blanket; the first cut in the second blanket being spaced inwardly from lateral edges of the first major surface of the second blanket and only partially severing the second blanket longitudinally to form first separable connector means in the second blanket; the first separable connector means in the second blanket separably joining adjacent blanket sections formed by the first cut in the second blanket for handling but permitting the adjacent blanket sections to be separated from each other by hand; and bonding the first major surface of the second blanket to the first major surface of the first blanket with the longitudinally extending first cut of the second blanket substantially aligned with the longitudinally extending first cut of the first blanket to form a resilient pre-cut fibrous insulation batt having a length equal to the length of the blankets, a width equal to the width of the blankets, and a thickness equal to the combined thicknesses of the blankets; the resilient pre-cut fibrous insulation batt having longitudinally extending batt sections separably joined by the first separable connector means of the first and second blankets whereby the pre-cut fibrous insulation batt is handled as a unit to insulate a cavity having a width about equal to the width of the resilient pre-cut fibrous insulation batt or the adjacent batt sections are separated by hand to insulate a cavity having a lesser width than the resilient pre-cut fibrous insulation batt.

18. The method of making a resilient pre-cut fibrous insulation batt according to claim 17, wherein:

the first cut in the first major surface of the first blanket is formed to a maximum depth less than the thickness of the first blanket so that the second major surface of the first blanket is uncut; and the first cut in the first major surface of the second blanket is formed to a maximum depth less than the thickness of the second blanket so that the second major surface of the second blanket is uncut.

19. The method of making a resilient pre-cut fibrous insulation batt according to claim 18, wherein:

the first cut in the first major surface of the first blanket is formed to a maximum depth about ⅛ to about 1/16 of an inch less than the thickness of the first blanket; and the first cut in the first major surface of the second blanket is formed to a maximum depth about ⅛ to about 1/16 of an inch less than the thickness of the second blanket.

20. The method of making a resilient pre-cut fibrous insulation batt according to claim 18, wherein:

the first cut formed in the first major surface of the first blanket is continuous; and the first cut formed in the first major surface of the second blanket is continuous.

21. The method of making a resilient pre-cut fibrous insulation batt according to claim 18, wherein:

the first cut formed in the first major surface of the first blanket is discontinuous with portions of the first separable connector means of the first blanket intermediate portions of the first cut in the first blanket; and the first cut formed in the first major surface of the second blanket is discontinuous with portions of the first separable connector means of the second blanket intermediate portions of the first cut in the second blanket.

22. The method of making a resilient pre-cut fibrous insulation batt according to claim 17, including:

forming a second cut in the first blanket; the second cut in the first blanket extending longitudinally in the first major surface of the first blanket, being spaced inwardly from the lateral edges of the first blanket and substantially parallel to and spaced from the first cut in the first major surface of the first blanket, and only partially severing the first blanket longitudinally to form second separable connector means in the first blanket; the second separable connector means in the first blanket separably joining adjacent blanket sections formed by the second cut in the first blanket for handling but permitting the blanket sections adjacent the second cut in the first blanket to be separated from each other by hand;

forming a second cut in the second blanket; the second cut extending longitudinally in the first major surface of the second blanket, being spaced inwardly from the lateral edges of the second blanket and substantially parallel to and spaced from the first cut in the first major surface of the second blanket, and only partially severing the second blanket longitudinally to form second separable connector means in the second blanket; the second separable connector means in the second blanket separably joining adjacent blanket sections formed by the second cut in the second blanket for handling but permits the blanket sections adjacent the second cut in the second blanket to be separated from each other by hand; and bonding the first major surface of the second blanket to the first major surface of the first blanket with the longitudinally extending second cut of the second blanket being substantially aligned with the longitudinally extending second cut of the first blanket whereby the resilient pre-cut fibrous insulation batt formed from the first and second blankets has longitudinally extending batt sections separably joined by the second separable connector means of the first and second blankets and the resilient pre-cut fibrous insulation batt is handled as a unit to insulate a cavity having a width about equal to the width of the resilient pre-cut fibrous insulation batt or the adjacent batt sections of the batt are separated by hand to insulate a cavity having a lesser width than the resilient pre-cut fibrous insulation batt.

23. The method of making a resilient pre-cut fibrous insulation batt according to claim 17, wherein:

the first and second blankets are made of glass fibers.

* * * * *